US005322086A

United States Patent [19]

Sullivan

[11] Patent Number: 5,322,086

[45] Date of Patent: Jun. 21, 1994

[54] HANDS-FREE, LEG-OPERATED, FAUCET-CONTROL DEVICE

[76] Inventor: Robert A. Sullivan, 4017 Ocean Dr., Manhattan Beach, Calif. 90266-3162

[21] Appl. No.: 975,461

[22] Filed: Nov. 12, 1992

[51] Int. Cl.[5] ..... F16K 11/24

[52] U.S. Cl. ..... 137/624.15; 137/599; 137/607; 137/613; 251/129.04

[58] Field of Search ..... 251/129.04; 137/599, 137/601, 607, 613, 624.11, 624.15

[56] References Cited

U.S. PATENT DOCUMENTS

| | | | |
|---|---|---|---|
| 3,491,381 | 1/1970 | Cathcart | 4/166 |
| 3,638,680 | 2/1972 | Kopp | 137/606 |
| 3,751,615 | 8/1973 | De Loisy | 200/86 |
| 3,830,991 | 8/1974 | Durocher | 200/86 |
| 3,898,737 | 8/1975 | Cope | 32/22 |
| 4,189,792 | 2/1980 | Veach | 4/192 |
| 4,757,943 | 7/1988 | Sperling et al. | 137/599 |
| 4,823,414 | 4/1989 | Piersimoni | 4/623 |
| 4,884,725 | 12/1989 | Ahad | 222/639 |
| 5,074,520 | 12/1991 | Lee | 251/40 |
| 5,095,941 | 3/1992 | Betz | 137/552 |
| 5,135,028 | 8/1992 | Rickenbach | 137/599 |

*Primary Examiner*—Stephen M. Hepperle

[57] ABSTRACT

A faucet-control device which enables users to control water flow in a basin fixture (10) by leaning against the front of the fixture (10) with a lower limb. Eight embodiments (A–H) are described. A normally-closed, electrically-controlled valve (16, 44, 46, or 62) controls water flow. A thin, flat, normally-open, momentary-contact, pressure-actuated mat switch (14) controls the valve (16, 44, 46, or 62). Any user in a normal stance may activate the mat switch (14) by applying a small pressure with a lower limb. In Embodiment A, activating the mat switch (14) opens the valve(s) (16), allowing water to flow. In Embodiment B, two stacked mat switches (14 and 14A) control a two-stage valve (44). In Embodiment C, a capacitive mat (50) enables the user to select continuously variable flow rates with a lower limb. A servo-drive circuit (48) converts variable capacitance from the capacitive mat (50) to an amplified current which drives a servo valve (46). In Embodiment D, the servo-drive circuit (48) drives a mixing valve (62). The mixing valve (62) provides continuously variable water temperatures in response to varying pressure on the capacitive mat (50). Embodiments E–H utilize four different faucet configurations, in combination with the valves (16, 44, 46, or 62) from Embodiments A–D.

16 Claims, 9 Drawing Sheets

FIGURE 1
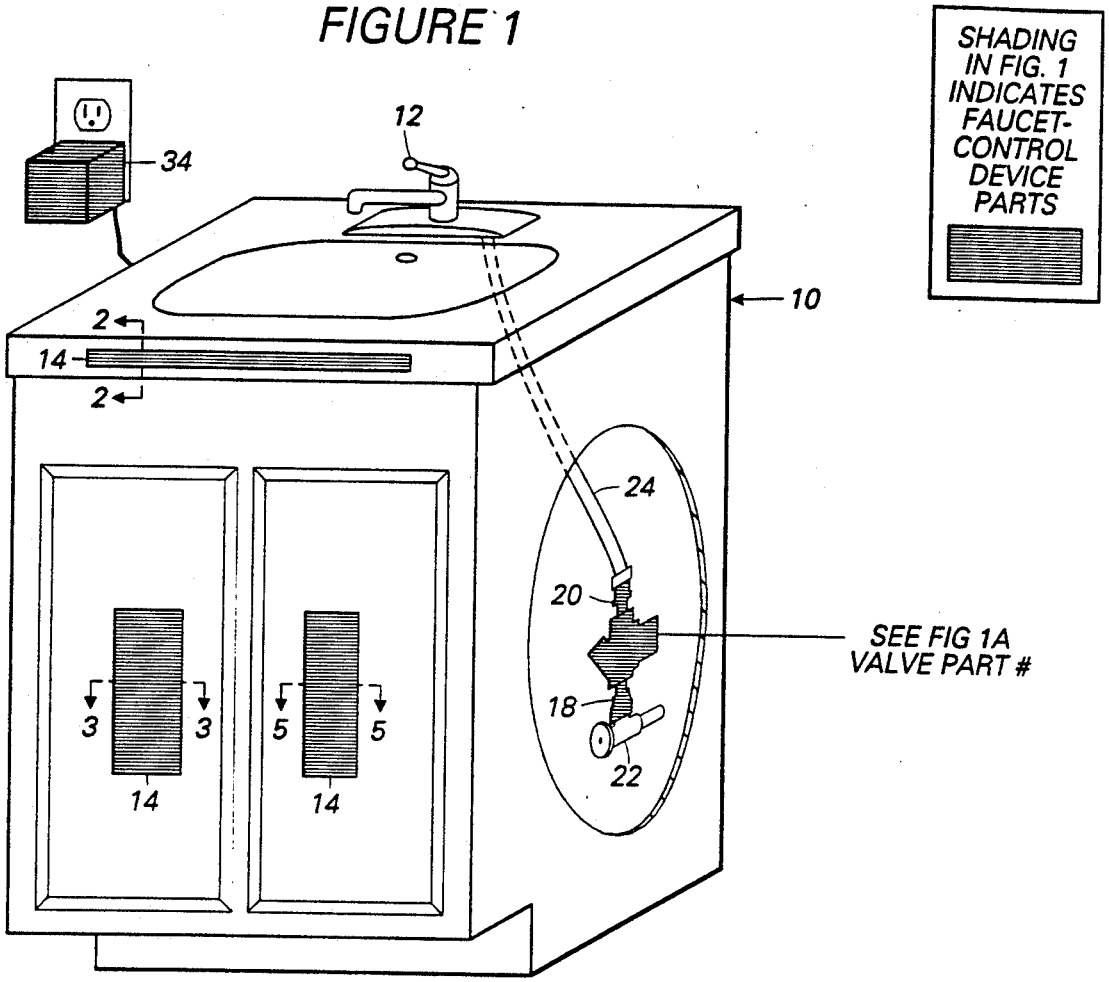
FIGURE 1A
| FOR EMBODIMENT- | A | B | C | D |
|---|---|---|---|---|
| USE VALVE PART # | 16 | 44 | 46 | 62 |
| REFER TO FIGURE # | 4C | 4D | 5D | 6D |
| SECTIONAL VIEW 2 | X | X | | |
| SECTIONAL VIEW 3 | X | X | | |
| SECTIONAL VIEW 5 | | | X | X |
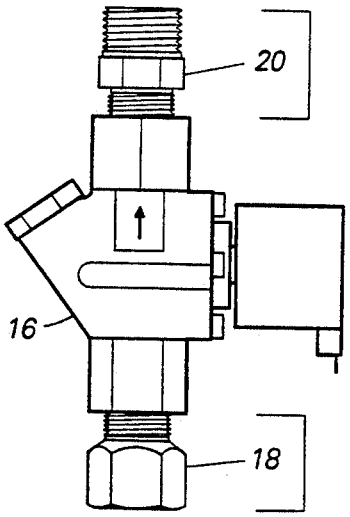
FIG. 1B

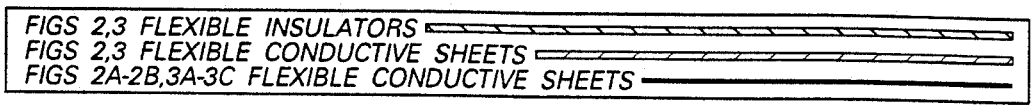
FIG. 2 - MAT SWITCH
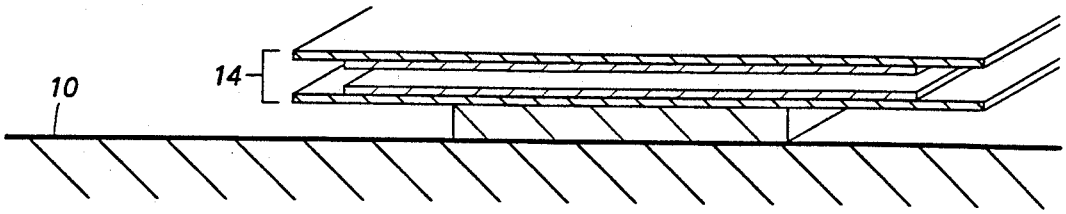
FIG. 2A
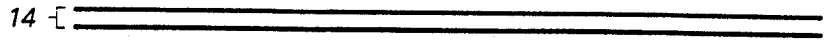
FIG. 2B
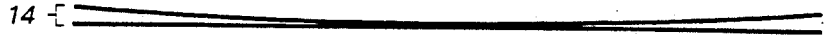
FIG. 3 - STACKED MAT SWITCHES
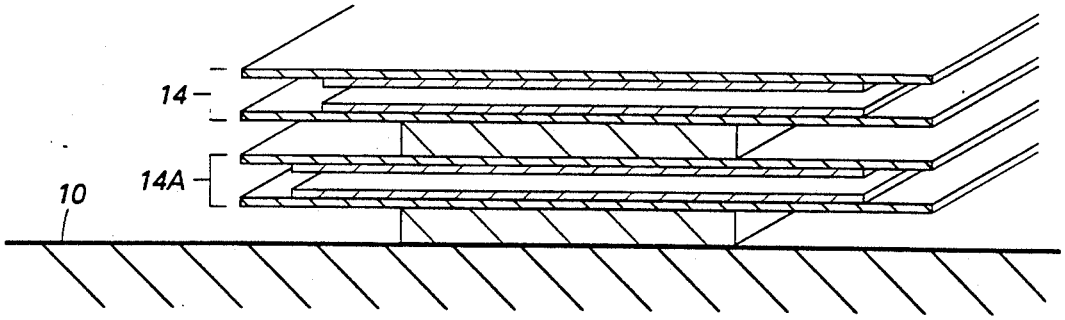
FIG. 3A
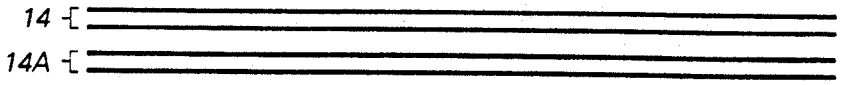
FIG. 3B
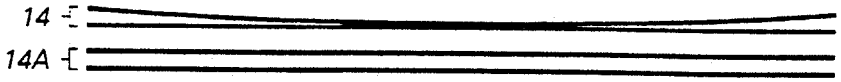
FIG. 3C
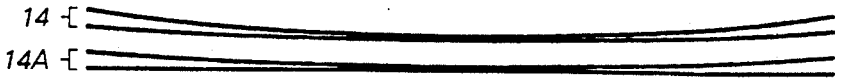

| WHEN USING VALVE # | 16 | 44 | 46 | 62 |
|---|---|---|---|---|
| REFER TO EMBODIMENT | A | B | C | D |

| FOR EMBODIMENT | E | F | G |
|---|---|---|---|
| USE FAUCET PART # | 66 | 72 | 74 |
| REFER TO FIGURE # | 8A | 8B | 8C |

FIGURE 9
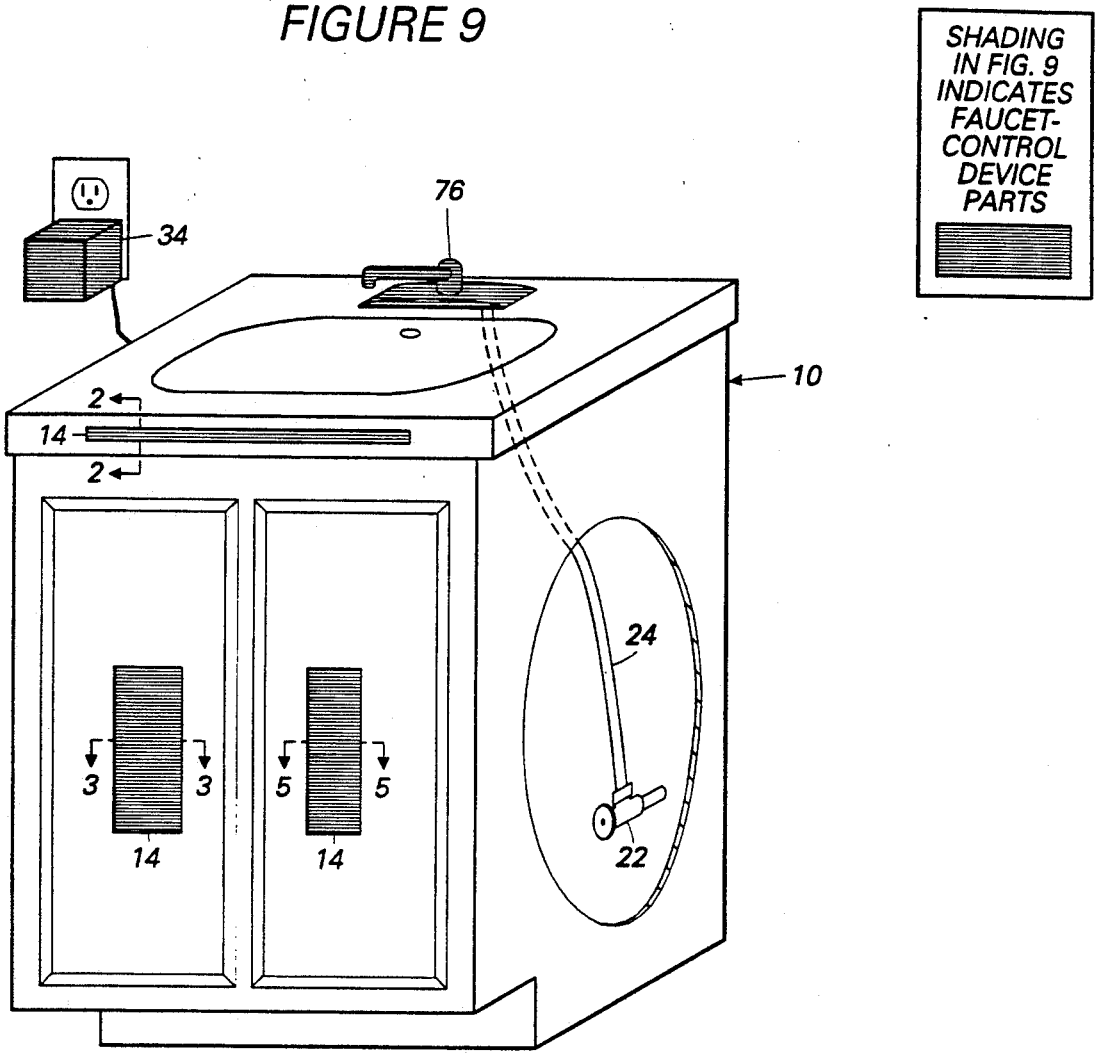
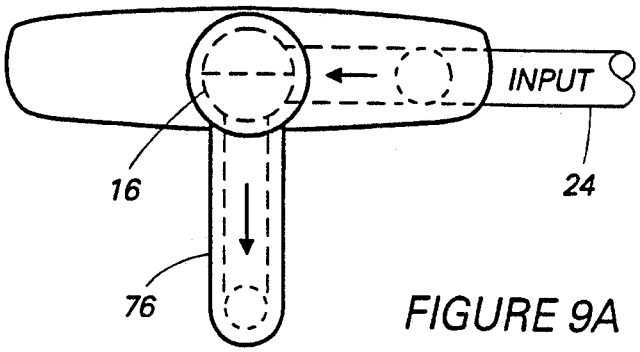
FIGURE 9A

HANDS-FREE, LEG-OPERATED, FAUCET-CONTROL DEVICE

BACKGROUND

1. Field of Invention

This invention relates to faucets, specifically to a device which enables users to control water flow in a basin fixture by leaning against the front of the basin fixture with their lower body.

2. Description of Prior Art

Previous inventions use foot pedals, knee operated devices, timers, and proximity detectors to attain the benefits of hands-free, faucet control.

In U.S. Pat. No. 5,135,028 to Richenbach (1992), a foot switch actuates water flow. Effort and thought must go into placing the foot correctly. A change in stance is often required, particularly when stopping and restarting water flow. The foot switch can cause tripping or toe injuries, as it mounts in the area where the user normally moves his/her feet.

The invention described in U.S. Pat. No. 5,095,941 to Betz (1992) uses an air bulb, instead of an obtrusive pedal or switch. Mounting the air bulb can be difficult depending on the type of basin fixture and floor covering. The air bulb necessitates pneumatic lines and devices which complicate aesthetic and inexpensive installation. If mounted higher, the air bulb may be knee actuated. The knee actuated air bulb limits users, according to their height and stance. Larger air bulbs can solve this. However, larger air bulbs make installation and aesthetic coordination more difficult.

In U.S. Pat. No. 4,884,725 to Ahad (1989), a timer controls water flow. Some use of the hands is still required with most timers. The lack of specific and direct flow control makes their use impractical in residential settings. Timers are often inconvenient in public facilities also.

In U.S. Pat. No. 5,074,520 to Lee (1991), a proximity detector controls water flow based on the proximity of the hands or other objects to the waterspout. To implement this invention, any preexisting faucet must be replaced. In U.S. Pat. No. 4,823,414 to Piersimoni (1989), the proximity detector is not part of the faucet, and faucet replacement is not necessary. However, installation often requires drilling into the basin. In both cases, the electronic circuitry involved can raise the cost substantially. More expense may result if there is concern about the aesthetic coordination of the proximity detector with the faucet and/or the basin fixture.

Many versions of the aforementioned faucet-control techniques predated these more modern versions. The majority of the older versions are more complicated, more difficult to install, and generally less desirable. A discussion of the older versions is redundant and lengthy. A discussion of various combinations of the aforementioned faucet-control techniques is also redundant.

Foot pedals, knee operated devices, timers, and proximity detectors are in use. However, to my knowledge, there is no significant residential usage. Many public facilities also lack hands-free, faucet-control devices. The spread of germs and other contaminants is especially an issue in public facilities. As population grows and the usable water supply decreases, economic water conservation devices will be increasingly crucial. Generally, people only use water-conservation devices that are convenient, affordably priced, and inexpensive to install and operate. In many cases, the above described devices require a professional plumber for installation. Many of the above devices use electric power constantly, whether they are in use or not. The amounts vary, but may become significant as electric power costs and environmental concerns increase. Also, if the device is aesthetically displeasing, its widespread use will be diminished, particularly in affluent areas.

OBJECTS AND ADVANTAGES

Accordingly, several objects and advantages of this faucet-control device are:

(a) to provide a faucet-control device which conveniently facilitates flexible flow control and water conservation, and whose operation does not require users to change their stance;

(b) to provide a hands-free, faucet-control device which does not create a safety hazard by protruding into the user's area of mobility;

(c) to provide a faucet-control device which accommodates multiple users of various heights;

(d) to provide a hands-free, faucet-control device which is aesthetically pleasing;

(e) to provide a hands-free, faucet-control device which will prevent the spread of germs and other contaminants due to users touching manually-operated controls;

(f) to provide a faucet-control device with an affordable cost, which allows widespread use;

(g) to provide a faucet-control device which readily installs with no basin modifications;

(h) to provide a hands-free, faucet-control device which readily installs into a basin fixture with minor, non-defacing modifications to the basin enclosure;

(i) to provide a hands-free, faucet control device which readily installs with minor plumbing modifications, in most cases not requiring a professional plumber; and (j) to provide a hands-free, faucet control device which uses minimal electric power.

Further objects and advantages of the hands-free, leg-operated, faucet-control device will become apparent from a consideration of the drawings and ensuing description of it.

DRAWING FIGURES

In the drawings, closely related figures have the same number but different alphabetic suffixes.

FIG. 1 shows a faucet-control device (Embodiment A, B, C, or D) installed in a basin fixture.

FIG. 1A table correlates Embodiments A–D with their respective valves, FIGS, and sectional views.

FIG. 1B shows the prototype valve and the plumbing adaptors of FIG. 1 in more detail.

FIG. 2 is a sectional view along view line 2—2 in FIGS. 1, 7, and 9, showing a mat switch.

FIGS. 2A and 2B depict flexible conductive sheets inside the mat switch shown in FIG. 2.

FIG. 3 is a sectional view along view line 3—3 in FIGS. 1, 7, and 9, showing stacked mat switches.

FIGS. 3A–3C depict flexible conductive sheets inside the stacked mat switches shown in FIG. 3.

FIGS. 6A-6C depict conductive sheets in the mat switch and capacitive mat of FIGS. 6D and 5.

Figures 7, 7A, 7B:
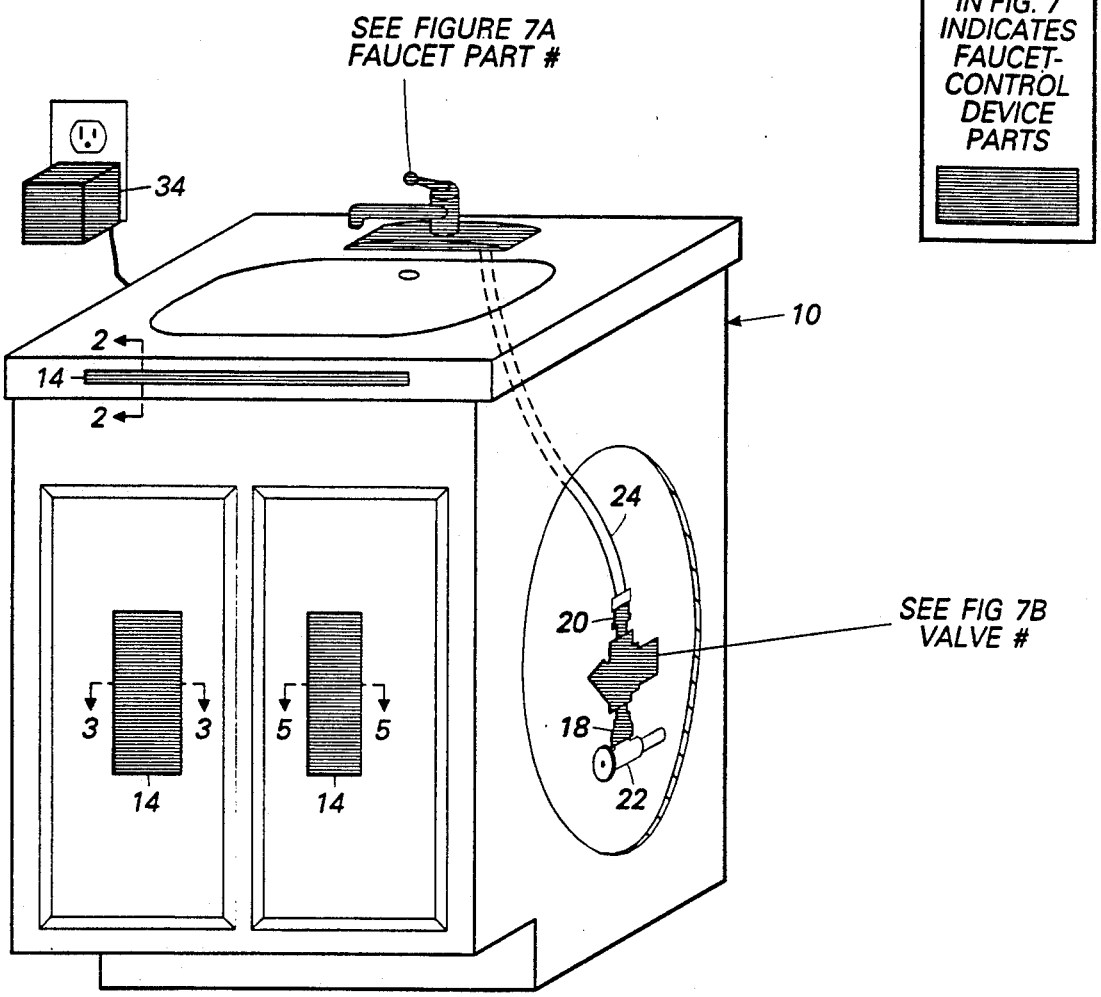
FIG. 7 shows a faucet-control device (Embodiment E, F, or G) installed in a basin fixture.

FIG. 7A table correlates Embodiments E-G with their respective faucets, and reference FIGS.

FIG. 7B correlates valves used in Embodiment E-H with their explanations in Embodiments A-D.

Figure 8A:
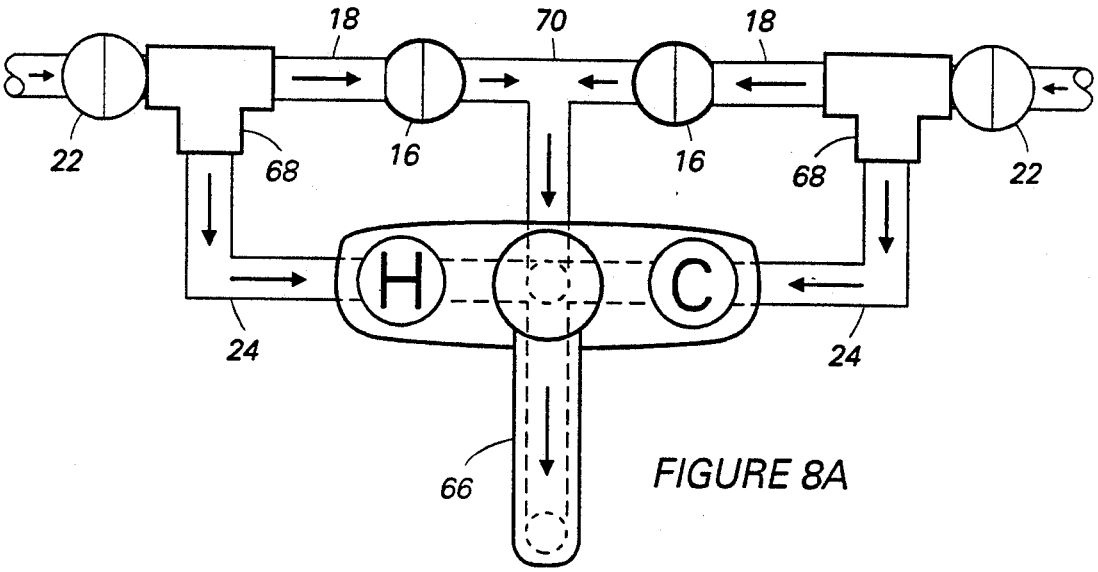
Figure 8B:
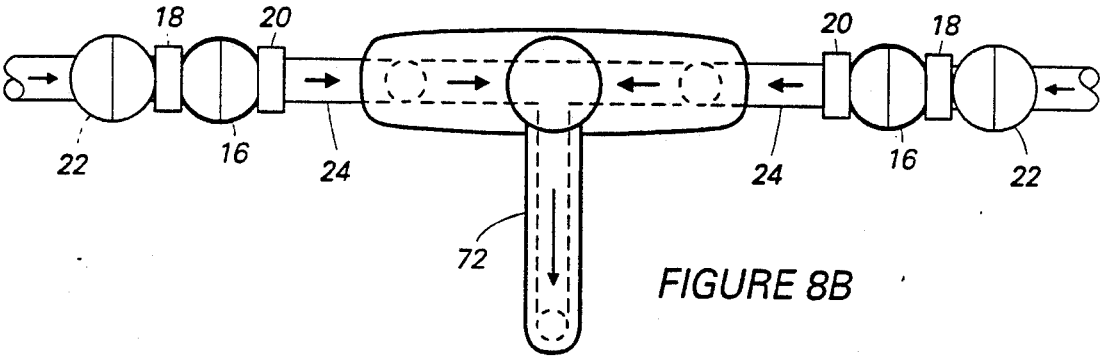
Figure 8C:
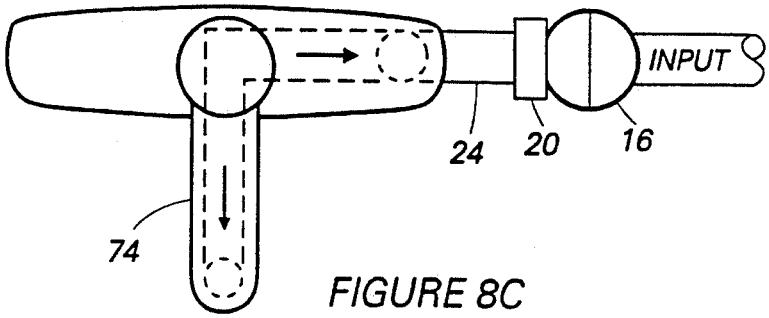

FIGS. 8A-8C show faucet and valve configurations E, F, and G, respectively.

FIG. 9 shows a faucet-control device (Embodiment H) installed in a basin fixture.

FIG. 9A shows one waterspout and valve configuration for Embodiment H.

REFERENCE NUMERALS IN DRAWINGS

10; basin fixture
12; preexisting faucet
14, 14A; mat switches
16; solenoid valve
18; valve-inlet adaptor
20; valve-outlet adaptor
22; supply valve
24; faucet connector
26; transformer
28; disable switch
30; bypass switch
32; timer
34; electronics case
36; power outlets
38; power-input plug
40,40A; relays
42,42A; resistors
44; two-stage valve
46; servo valve
48; servo-drive circuit
50; capacitive mat
52; variable oscillator
54; demodulator
56; flow control
58; servo-control circuit
60; power amplifier
62; mixing valve
64; temperature control
66; auto/manual faucet
68; T-connector
70; faucet adaptor
72; two-input waterspout
74; single-input waterspout
76; internal-valve waterspout.

SUMMARY

All Embodiments of the faucet-control device use a flat, thin, mat-shaped switch 14 to control water flow. Mat switch 14 enables control by the user's lower body from the front of a basin fixture 10. Embodiments A-D do not include faucets. They are accessories, used with a preexisting faucet 12 in basin fixture 10. FIG. 1 represents Embodiment A, B, C, or D installed in basin fixture 10 with preexisting faucet 12. Embodiments A-D each use a different type of valve.

(A) Solenoid-valve Embodiment A enables a predetermined flow rate when activated.

(B) Two-stage-valve Embodiment B allows the user to select two different flow rates.

(C) Servo-valve Embodiment C enables continuously variable flow rate control.

(D) Mixing-valve Embodiment D enables continuously variable temperature control.

Embodiments E-H do not use preexisting faucets 12, as Embodiments A-D do. Embodiments E-H each include one of four faucet types. Embodiments E-H utilize valves from Embodiments A-D.

(E) Auto/manual-faucet Embodiment E enables electronic and manual control of water flow.

(F) Waterspout Embodiment F uses a two-input waterspout 72.

(G) Single-input-waterspout Embodiment G uses a single-input waterspout 74 and external valve.

(H) Internal-valve-waterspout Embodiment H uses a waterspout with a built-in valve.

DESCRIPTION OF FIGS. 1A, 2, 3, 5, 1, 7, 9, 4A-4D, 5D, 6D-6E, 8A-8C, 9A

FIG. 1A correlates Embodiments A-D with their corresponding valves and reference FIGS. In FIG. 1A, an "X" in the corresponding row and column identifies which sectional views apply to each embodiment. Parts shown in sectional views 2, 3, and 5 mount anywhere on basin fixture 10. Their positions and sizes are not limited to the positions and sizes shown in FIGS. 1, 7, and 9. The parts in sectional views 2, 3, and 5 may also be duplicated at multiple positions on basin fixture 10, if desired. In FIGS. 1, 7, and 9, basin fixture 10 represents any conventional basin fixture, preexisting or new. No limitations in size, shape, or style are intended. In FIGS. 1, 7, 8A-8C, 9 and 9A, drawings of faucets (12, 66, 72, 74, and 76) are also not intended to limit size, shape, or style. In FIGS. 4A-4D, 5D, 6D-6E, 8A-8C, and 9A, circles with diametric lines depict a solenoid valve 16 or a supply valve 22, and rectangles may depict a valve-inlet adaptor 18 or a valve-outlet adaptor 20.

DESCRIPTION OF SOLENOID-VALVE EMBODIMENT A—FIGS. 1, 1B, 2-3C, 4A-4C, 4E-4G

FIG. 1 shows a faucet-control device in basin fixture 10 with preexisting faucet 12. Mat switch 14 on fixture 10 activates solenoid valve 16, which controls water flow. FIG. 1B shows valve-inlet adaptor 18, prototype valve 16, and valve-outlet adaptor 20, in more detail than FIG. 1.

FIG. 2 is a sectional view of mat switch 14, showing its general structure. It is flat and less than 7 mm thick. The height and width vary. Approximate heights and widths in centimeters are: 3 by 30, 1 by 60, 8 by 30, and 15 by 30. Mat switch 14 is a momentary-contact, normally-open, single-pole, single-throw switch. It is activated (closed electrically) by applying approximately 0.14–0.28 kilograms per square centimeter (2–4 pounds per square inch) to its surface. FIG. 2A shows two flexible conductive sheets in mat switch 14, with no pressure applied, it is open. FIG. 2B shows the flexible conductive sheets in mat switch 14, with pressure applied, it is closed. FIGS. 2A and 2B do not show the insulators in mat 14, as FIG. 2 does. Mat switch 14 weighs less than 0.7 grams per square centimeter, and mounts on basin fixture 10 with double-sided-foam tape or other fasteners. In FIG. 2, the rectangular area between mat 14 and basin fixture 10 depicts double-sided-foam tape.

Figure 4A:
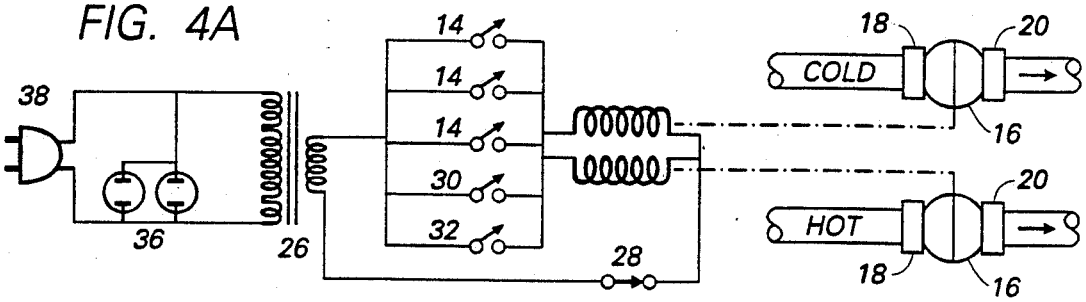
FIGS. 4A and 4B are wiring schematics or representations of Embodiment A, E, or F.
Figure 4B:
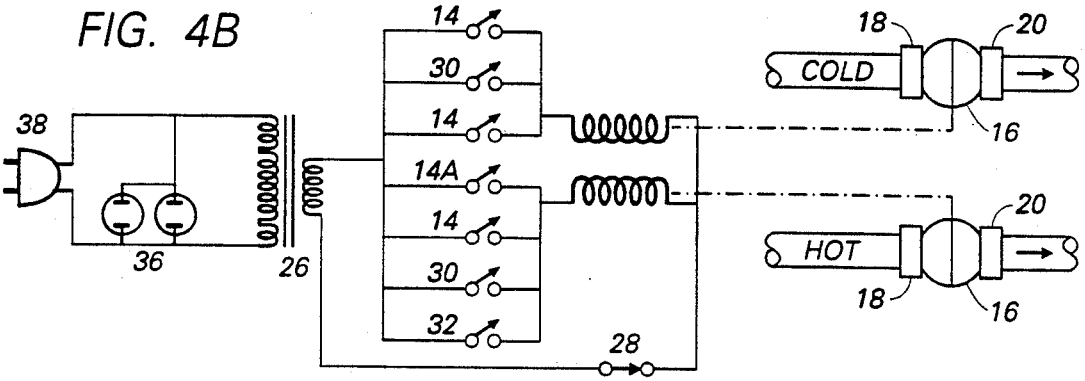
Figure 4C:
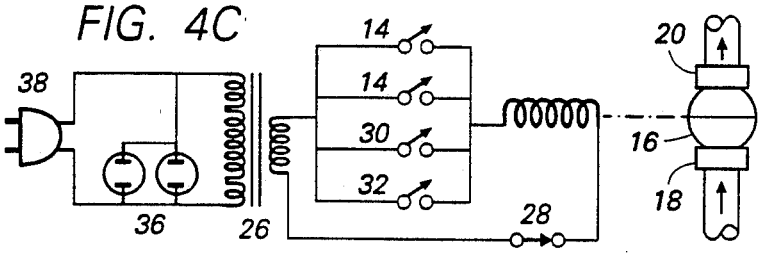
FIG. 4C is a wiring schematic or representation of Embodiment A, G, or H.

Mat switch 14 is wired to open solenoid valve 16. FIGS. 4A–4C show three possible wiring configurations. Diametric lines extend out of valves 16 to projection lines which join valves 16 to their corresponding coils. In FIG. 4A, any mat switch 14 opens both valves 16. In FIG. 4B, different mat switches 14 seperately open valves 16 in different water lines.

FIG. 1 shows only one valve 16, in the cold water line. Another valve 16 installs in the hot water line, if desired. Valve 16 installs in the plumbing of basin fixture 10, in-line, between supply valve 22 and a faucet connector 24. Supply valve 22 and faucet connector 24 are not part of the faucet-control device. They are part of basin fixture 10, into which the device is installed. Faucet connector 24 may be a flexible hose, a flexible metal pipe, or a riser tube. Inlet adaptor 18 joins valve 16 to supply valve 22. Outlet adaptor 20 joins valve 16 to faucet connector 24. Adaptors 18 and 20 may include flexible hoses to facilitate adaptation and installation.

Common plumbing in basin fixture 10 utilizes a 12.7 mm (½") supply-valve 22 output and corresponding faucet connector 24. In this case, shown in FIG. 1B, adaptor 18 is a 12.7 mm by 9.5 mm (½" by ⅜") female to male adaptor. Adaptor 20 is a 12.7 mm by 9.5 mm (½" by ⅜") hex reducing nipple. FIG. 1B applies to valve 16 with a 9.5 mm (⅜") female inlet and outlet. All dimensions in this paragraph refer to national pipe thread fitting sizes.

Adaptors 18 and 20 vary if valve 16 has a different size inlet or outlet. They also vary according to the plumbing into which they are installed. To my knowledge, all plumbing can be adapted with widely available reducers, nipples, bushings, compression fittings, and flexible hoses.

A transformer 26 provides power for solenoid valve 16. It has a 120-volt, alternating-current input, and a 24-volt, alternating-current output. It is shown in schematic form in FIGS. 4A–4C. Transformer 26 may vary based on the coil voltage of solenoid valve 16, and the available power.

Figure 4D:
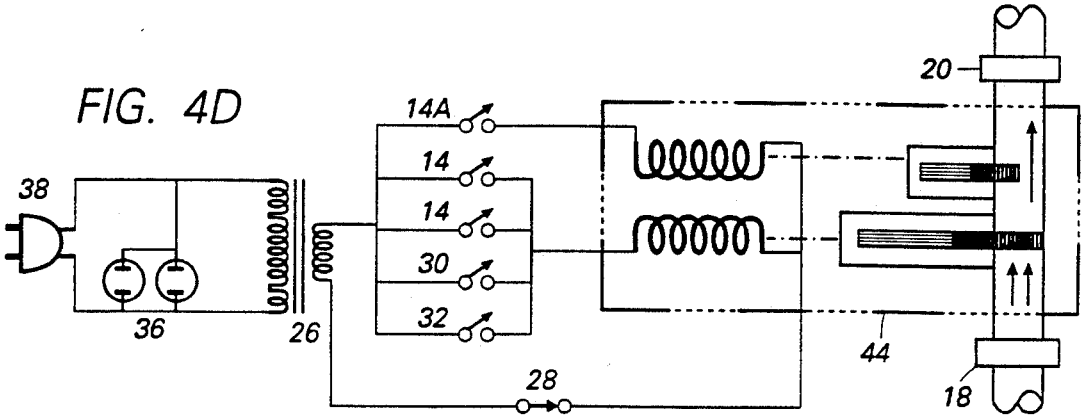
FIG. 4D is a wiring schematic and representation of two-stage-valve Embodiment B.

FIGS. 4A–4C also show a disable switch 28, a bypass switch 30, and a timer 32. They are single-pole, single-throw, two-position switches capable of 1 amp at 30 volts. Possible mounting locations for switches 28, 30, and 32 are: basin-fixture 10 enclosure and an electronics case 34. FIG. 4G shows a version of case 34. Switches 28 and 30 are depicted as rocker switches on the right side of case 34. A rectangular knob and time settings depict timer 32. A pair of power outlets 36 connects to a power input plug 38, which accesses power for transformer 26. FIGS. 4A–4C show input plug 38. It is not visible in FIG. 4G because it is on the back of case 34. FIG. 1 shows a version of case 34 which only contains input plug 38 and transformer 26. The size and shape of case 34 can be modified to allow for mounting of any related circuitry. All electrical devices shown in FIG. 4G are optional and interchangeable with similar devices.

Stacked mat switches 14 and 14A are another option. FIG. 3 shows their general structure in section. Mat 14A is not visible in FIG. 1, because it is under mat 14. In FIG. 3, the rectangular area between mats 14 and 14A depicts double-sided-foam tape. The rectangular area between mat 14A and basin fixture 10 is the same. In FIGS. 3A–3C, the conductive sheets of mats 14 and 14A are depicted in three different states. FIGS. 3A–3C do not show the flexible insulators, as FIG. 3 does. Mat 14A requires more pressure to activate than mat 14. The difference in sensitivity causes mat 14 to activate before mat 14A, as in FIG. 3B. As applied pressure increases, mat 14A also activates, as in FIG. 3C. Mats 14 and 14A can control two separate valves 16, from one point of contact. In the following functional explanation, mat switch 14 is the uppermost one in FIG. 4B.

In FIG. 3A, no pressure is applied, switches 14 and 14A are open. All water flow is off.

In FIG. 3B, a small pressure is applied, switch 14 is closed. Switch 14A is open.

Reference FIG. 4B. Valve 16 in the cold water line is open. Cold water flow is on.

In FIG. 3C, more pressure is applied, both switches 14 and 14A are closed.

Reference FIG. 4B. Both valves 16 are open. Cold and hot water flow is on.

Figure 4E:
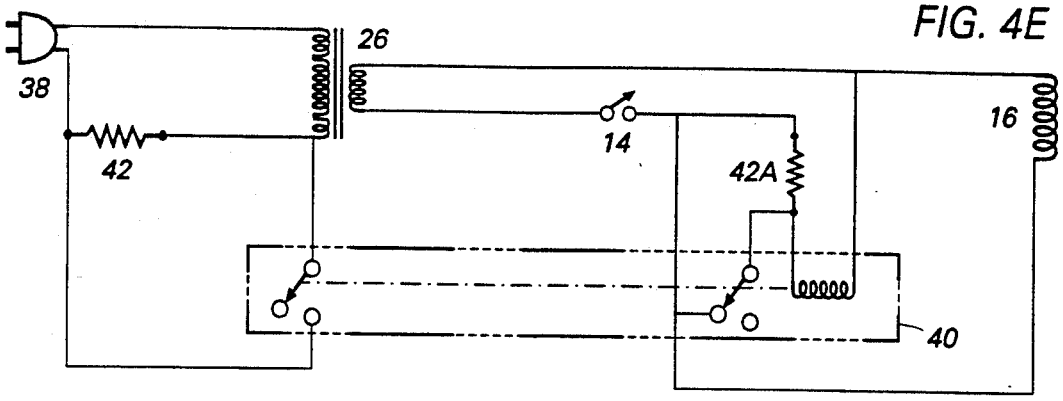
FIGS. 4E and 4F are schematics of two versions of the idle-time-power-use-reduction circuit.

FIG. 4E shows an optional circuit which reduces power consumption when transformer 26 is not in use. A resistor 42 significantly reduces current flow through transformer 26 primary. Resistor 42 allows sufficient current through transformer 26 for the coil in a relay 40. Relay 40 is double-pole, double-throw with an alternating-current coil which activates at 12 volts or less. When switch 14 closes, relay 40 activates, and resistor 42 is shorted. A resistor 42A prevents damage to relay 40 coil and keeps relay 40 activated until switch 14 opens. Valve 16 coil is the load for this circuit.

Figure 4F:
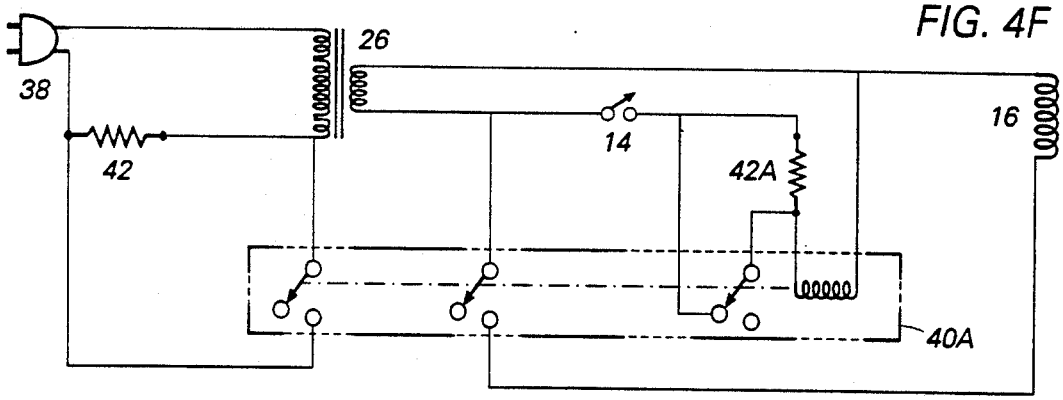
Figure 4G:
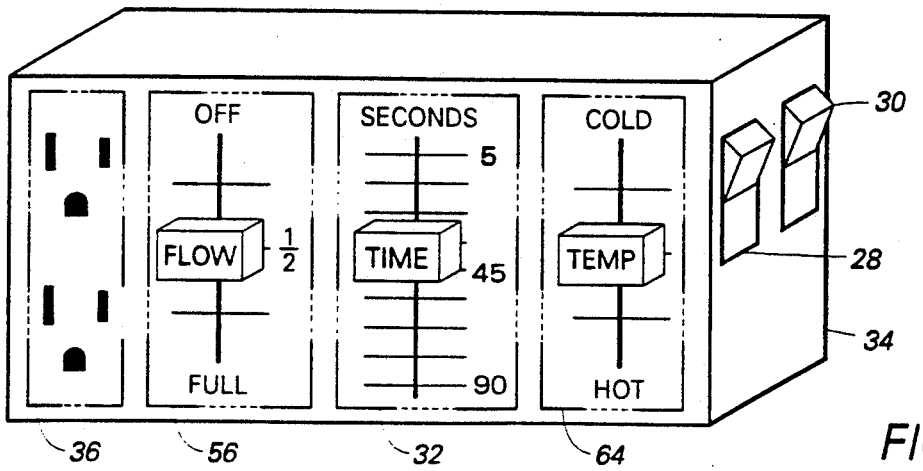
FIG. 4G illustrates one version of an electronics case, with optional electronic devices installed.

FIG. 4F shows a similar circuit with a triple-pole, double-throw relay 40A. Relay 40A isolates mat switch 14 from the load current. The load current is directed through the third single-pole, double-throw section of relay 40A. This circuit is useful when load current exceeds the limits of mat switch 14. Relays 40 and 40A contacts can conduct 3 amps at 120 volts.

Embodiment A is the fundamental embodiment. Subsequent embodiments are derivatives.

OPERATION OF SOLENOID-VALVE EMBODIMENT A—FIGS. 1, 4A–4C, 4G

Operation of Embodiment A varies based on the positions of mat switches 14 and 14A, and their wiring. Reference FIGS. 1 and 4A–4C. In all cases, mat switches 14 and 14A provide a safe and convenient means for the user's legs to control water flow. The user's hands are free to wash, rinse, etc. The various sizes of mat switch 14 facilitate mounting on virtually any basin fixture 10. Various non-defacing fasteners such as the hook and loop type can support mat 14, because of its light weight. In FIG. 1, two lower mats 14 activate by pressure applied with a knee. Upper mat 14 activates by pressure applied with a thigh. Mats 14 allow the user to assume a normal and natural stance while controlling water flow. Gently leaning against any mat 14 starts the flow of water. Leaning away from mat 14 stops water flow. Because users stand very close to basin fixtures 10, they can execute these actions with great ease. Mat switch 14 is dielectrically-sealed for safety. The flat structure of mat 14 allows decoration with various paints, cloth materials, veneers, etc.

In order for valves 16 to control water flow, any manually-operated valves in preexisting faucet 12 must stay in an open position. This reduces their wear and reduces the need for cleaning. Manually-operated valves in preexisting faucet 12 or supply valves 22 may adjust flow rate.

FIGS. 4A–4C and FIG. 4G show four optional electrical controls. Their use is not limited to the wiring configurations in FIGS. 4A–4C. The user may chose other wiring configurations, if desired.

1. Placing disable switch 28 in the off (open) position disables all water flow.
2. Placing bypass switch 30 in the on (closed) position allows maintained water flow independent of mat switches 14 and 14A.
3. Timer 32 allows maintained water flow for a predetermined time, independent of mats 14 and 14A. FIG. 4G shows a version that can be set in the range of 5 to 90 seconds.
4. Stacked mat switches 14 and 14A allow the user to control one water line as explained above. Applying more pressure to mat 14 enables water flow in a separate water line.

DESCRIPTION OF TWO-STAGE-VALVE EMBODIMENT B—FIGS. 1, 2, 3-3C, 4D

Embodiment B differs from Embodiment A in the following two ways:

1. A two-stage valve 44 replaces valve 16 and installs as shown in FIG. 1 and FIG. 4D. The first stage of valve 44 enables a predetermined slow-flow rate. The second stage enables a predetermined fast-flow rate. In FIG. 4D, the first stage of valve 44 is depicted by the larger of the two pairs of shaded rectangles. The second stage is depicted by the smaller pair of shaded rectangles. The corresponding coils for the two stages are connected by projection lines. In Embodiment B, valve 44 replaces valve 16 coil as the load in FIG. 4E or FIG. 4F.
2. Stacked mat switches 14 and 14A control water flow, as shown in FIG. 4D schematic. Also reference FIGS. 3-3C. A functional explanation of mats 14 and 14A in Embodiment B follows:
   - In FIG. 3A, no pressure is applied, switches 14 and 14A are open. Water flow is off.
   - In FIG. 3B, a small pressure is applied, switch 14 is closed. Switch 14A is open. Reference FIG. 4D. The first-stage, slow-flow rate is enabled. The second stage is closed.
   - In FIG. 3C, more pressure is applied, both switches 14 and 14A are closed. Reference FIG. 4D. The first stage and second stage are open. Fast-flow rate is enabled.

FIG. 2 depicts mat switch 14. Mat switch 14 may also control valve 44 first stage, independent of stacked mats 14 and 14A shown in FIG. 3. Reference FIG. 4D wiring schematic.

OPERATION OF TWO-STAGE-VALVE EMBODIMENT B—FIG. 1

Operation of Embodiment B differs from operation of Embodiment A as follows. In Embodiment A, the user activates mat switch 14 to attain one flow rate. Reference FIG. 1. In Embodiment B, activating mat 14 causes a slow flow of water. By applying more pressure to mat 14, a faster flow rate results. The user chooses from two flow rates, without using the hands.

DESCRIPTION OF SERVO-VALVE EMBODIMENT C—FIGS. 1, 4G, 5-5D

Figure 5:
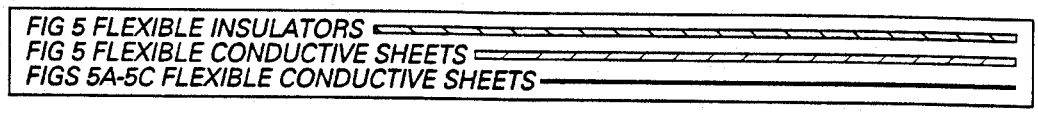
FIG. 5 is a sectional view along view line 5—5 in FIGS. 1, 7, and 9.
Figure 5A:
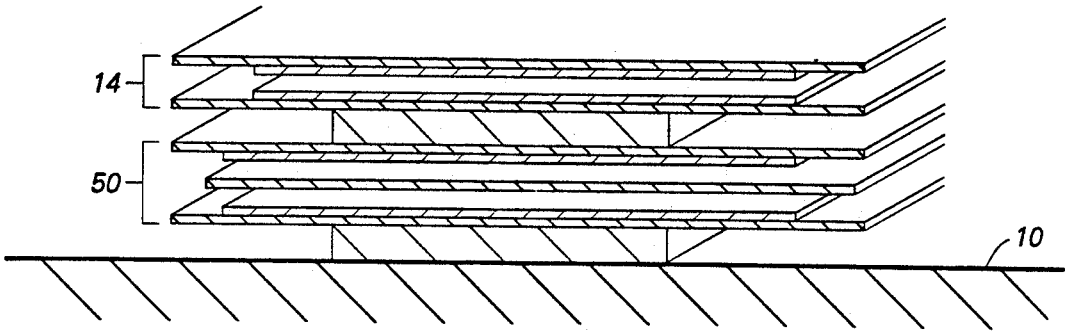
FIGS. 5A-5C depict conductive sheets inside the mat switch and capacitive mat of FIG. 5.
Figure 5B:
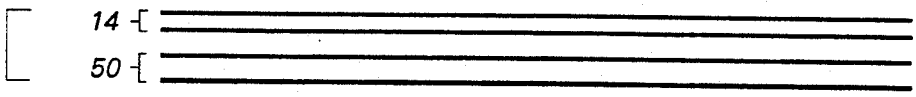
Figure 5C:
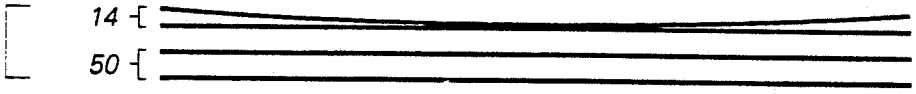
Figure 5D:
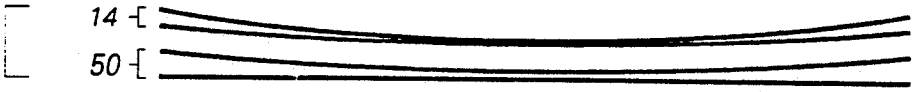
FIG. 5D is a block diagram and representation of servo-valve Embodiment C.
Figure 5D:
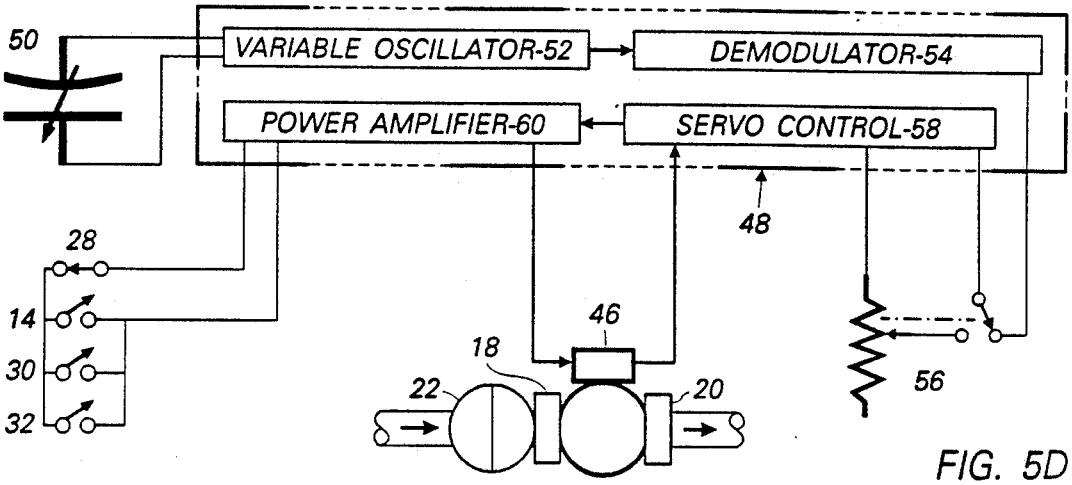

Embodiment C differs from Embodiment A in the following three ways:

1. A servo valve 46 replaces valve 16, and installs as shown in FIGS. 1 and 5D. Valve 46 controls water flow rate electronically. In FIG. 5D, a circle with a rectangle atop it depicts valve 46.
2. A servo-drive circuit 48 converts capacitance from a capacitive mat 50 to a servo output which drives valve 46. In Embodiment C, circuit 48 replaces valve 16 coil as the load in FIG. 4E or FIG. 4F. Circuit 48 may mount in electronics case 34. Reference FIG. 4G. FIG. 5D block diagrams servo-drive circuit 48. A functional explanation of the inputs and outputs follows:
   - A variable oscillator 52 converts variable capacitance from mat 50 to a variable frequency.
   - A demodulator 54 converts the variable frequency to a variable drive current. When switched on, a flow control 56 overrides demodulator 54 by providing a manually-selected drive current from a potentiometer. FIG. 5D shows flow control 56 switched off. FIG. 4G depicts flow control 56 as a rectangular knob and flow settings
   - In FIG. 5D, a servo-control circuit 58 monitors servo valve 46, and the drive current from demodulator 54 or flow control 56. Circuit 58 continuously adjusts its output accordingly.
   - A power amplifier 60 amplifies the drive current from servo control 58. The amplified drive current from power amplifier 60 drives servo valve 46.
3. Embodiment C uses mats 14 and 50. FIG. 5 sectional view shows their general structure. In FIG. 1, mat 50 is under mat 14, and is not visible. In FIG. 5, the rectangular area between mat 14 and mat 50 depicts double-sided-foam tape. The rectangular area between mat 50 and basin fixture 10 is the same. Mat 50 requires more pressure to activate than mat 14. The difference in sensitivity causes mat 14 to activate before mat 50, as in FIG. 5B. FIGS. 5A–5C do not show the insulators in mat 14 and mat 50, as FIG. 5 does. As pressure applied to mats 14 and 50 increases, capacitive mat 50 acts as a variable capacitor because of the decreasing distance between the two conductive sheets, as in FIG. 5C. A functional explanation follows:
   - In FIG. 5A, mat switch 14 is open, no pressure is applied. When switch 14 is open, drive circuit 48 is off. Reference FIG. 5D. Valve 46 has no drive current. Water flow is off.
   - In FIG. 5B, mat switch 14 is closed. Servo-drive circuit 48 is on. Reference FIG. 5D. Minimal water flow starts. Capacitive mat 50 does not respond to the small pressure.
   - In FIG. 5C, mat switch 14 is closed. Capacitive mat 50 is flexed by more pressure, creating a larger capacitance. Servo-drive circuit 48 converts the larger capacitance to an increased drive current which drives servo valve 46. Water flow increases accordingly.

OPERATION OF SERVO-VALVE EMBODIMENT C—FIGS. 1, 4G

Operation of Embodiment C differs from operation of Embodiment A as follows. In Embodiment A, the user activates mat switch 14 to attain one flow rate. Reference FIG. 1. In Embodiment C, activating mat 14 causes a minimal flow of water. By applying more pressure to mat 14, flow rate gradually increases until maximum flow is achieved. The user controls flow rate with the lower body. His/her hands are free to wash, rinse, etc. When used, flow control 56 sets a selected flow rate, independent of additional pressure applied to mat switch 14. Reference FIG. 4G.

DESCRIPTION OF MIXING-VALVE EMBODIMENT D—FIGS. 1, 4G, 5, 5D, 6—6E

Figure 6D:
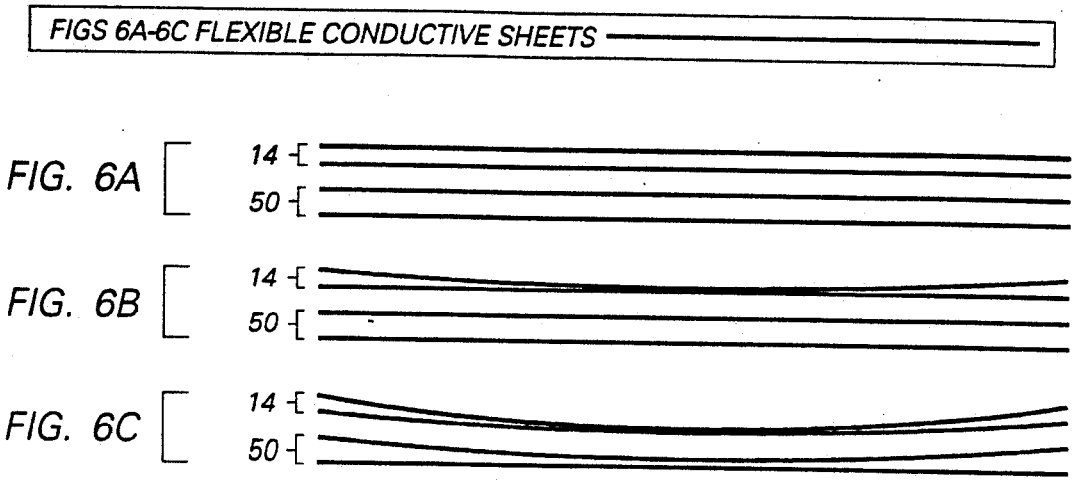
FIG. 6D is a block diagram and representation of mixing-valve Embodiment D.
Figure 6D:
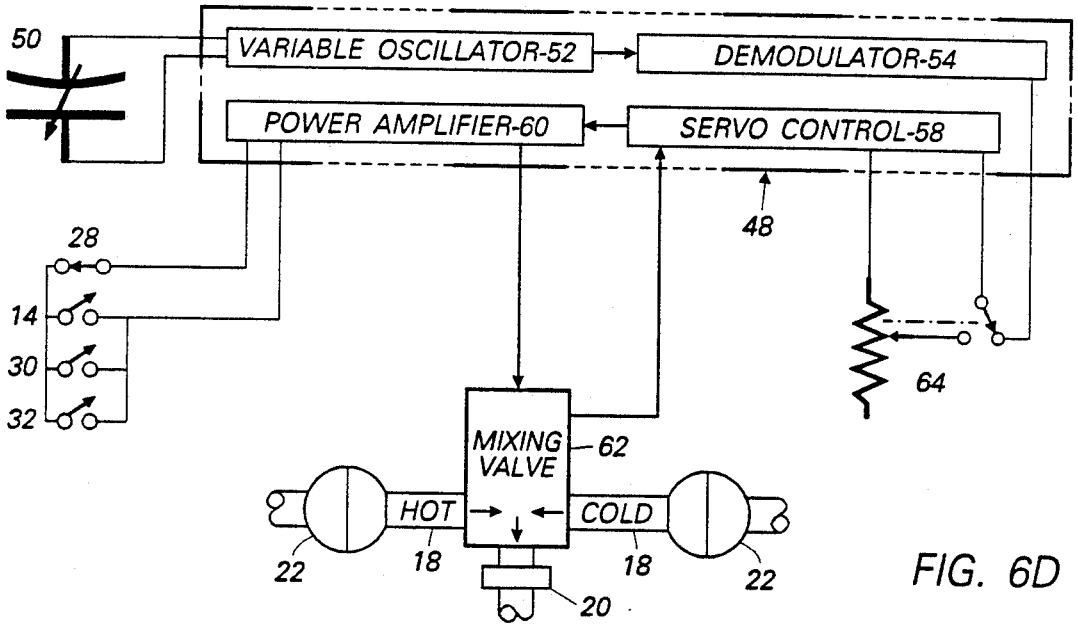

Embodiment D differs from Embodiment C in the following three ways:

1. A mixing valve 62 replaces servo valve 46. In FIG. 6D, a rectangle depicts mixing valve 62. Valve 62 controls water temperature by mixing varying proportions of cold and hot water. With no drive-current input, mixing valve 62 stops all water flow. With minimum drive-current input, mixing-valve 62 output is all cold water. As drive current from circuit 48 increases, more hot water mixes into the output. Two valve adaptors 18, with flexible hoses, route hot and cold water from supply valves 22 to valve 62.
2. FIG. 6D block diagrams servo-drive circuit 48, as it is used in Embodiment D. Compare FIG. 5D and FIG. 6D. A functional explanation of the inputs and outputs follows:
   - Variable oscillator 52 converts variable capacitance from mat 50 to a variable frequency.
   - Demodulator 54 converts the variable frequency to a variable drive current. When switched on, a temperature control 64 overrides demodulator 54 with a selected drive current from a potentiometer. FIG. 6D shows temperature control 64 switched off. FIG. 4G depicts temperature control 64 as a rectangular knob with hot and cold settings.
   - In FIG. 6D, servo-control circuit 58 monitors mixing valve 62, and the drive current from demodulator 54 or temperature control 64. Servo-control circuit 58 continuously adjusts its output accordingly.
   - Power amplifier 60 amplifies the drive current from servo-control circuit 58. The amplified drive current from power amplifier 60 drives mixing valve 62.
3. Embodiment D also uses capacitive mat 50 and mat switch 14. In Embodiment C mats 14 and 50 control servo valve 46. In Embodiment D, mats 14 and 50 control mixing valve 62. The following is a functional explanation. Reference FIGS. 6A-6C and FIG. 6D.
   - In FIG. 6A, mat switch 14 is open, no pressure is applied. When switch 14 is open, servo drive 48 is off. Reference FIG. 6D. Valve 62 has no drive current. Water flow is off.
   - In FIG. 6B, mat switch 14 is closed. Servo-drive circuit 48 is on. Reference FIG. 6D. Cold water flow starts. Capacitive mat 50 does not respond to the small pressure.
   - In FIG. 6C, mat switch 14 is closed. Capacitive mat 50 is flexed by more pressure, creating a larger capacitance. Servo-drive circuit 48 converts the larger capacitance to an increased drive current which drives mixing valve 62. Water temperature increases accordingly.

Figure 6E:
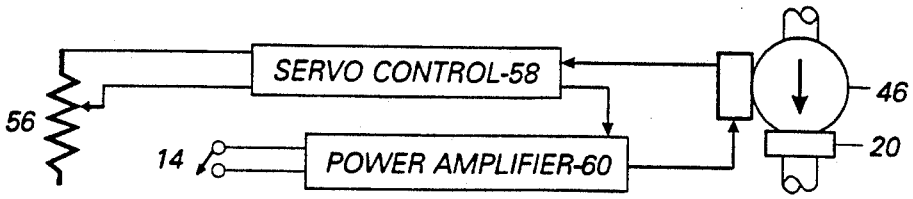
FIG. 6E is a block diagram of the servo-valve output for mixing valve Embodiment D.

FIG. 6E shows an optional output for Embodiment D. A circle with a rectangle on its left side depicts servo valve 46. When used, servo valve 46 in FIG. 6E connects between adaptor 20 and the output of valve 62 in FIG. 6D. Mat switch 14 in FIG. 6E is the same mat switch 14 in FIG. 6D. Servo-control 58 and power amplifier 60 in FIG. 6E are additional to those in FIG. 6D. In FIG. 6E, mat switch 14, flow control 56, servo control 58, and power amplifier 60 all control valve 46. The function of additional circuit 56, 58, and 60 is identical to servo-drive circuit 48 in Embodiment C, except that oscillator 52 and demodulator 54 are not used. In this configuration, drive current for valve 46 comes from flow control 56, exclusively. Also, reference FIG. 4G.

OPERATION OF MIXING-VALVE EMBODIMENT D-FIGS. 1, 4G, 6E

Operation of Embodiment D differs from operation of Embodiment C as follows. See FIG. 1. In Embodiment C, the user varies pressure on mat switch 14 to control water flow rate. In Embodiment D, activating mat 14 causes a flow of cold water. By applying more pressure to mat 14, water temperature gradually increases until maximum water temperature is reached. The user controls the water temperature with the lower body, leaving his/her hands free to wash, rinse, fill, etc. When used, temperature control 64 sets a selected temperature, independent of additional pressure applied to mat 14. Reference FIG. 4G. If installed, the optional servo-valve 46 output (see FIG. 6E) enables flow rate control 56 (also see FIG. 4G).

DESCRIPTION OF COMBINATIONS OF EMBODIMENTS A-C—FIG. 1A

Combinations of Embodiments A-C are possible by installing one Embodiment in the cold water line, and another Embodiment in the hot water line. Reference FIG. 1A.

DESCRIPTION OF EMBODIMENTS E-H—FIGS. 7-7B, 9

Embodiments E-H differ notably from Embodiments A-D. Embodiments A-D do not include faucets. Embodiments E-H each include a faucet. FIG. 7 represents Embodiment E, F or G, installed in basin fixture 10. FIG. 7A correlates Embodiments E-G with their corresponding faucets, and reference FIGS. FIG. 9 represent Embodiment H installed in basin fixture 10. Embodiments E-H utilize valves (16, 44, 46, and/or 62) from Embodiments A-D. FIG. 7B correlates valves 16, 44, 46, and 62 with their respective descriptions and operational explanations in Embodiment A-D.

DESCRIPTION OF AUTO/MANUAL-FAUCET EMBODIMENT E—FIGS. 7, 1, 8A, 4D, 5D

Embodiment E differs from Embodiment A in that it uses an auto/manual faucet 66, instead of preexisting faucet 12. Compare FIG. 7 and FIG. 1. In FIG. 8A, a pair of T-connectors 68 connect supply valves 22 to faucet connectors 24 and adaptors 18. Valve adaptors 18 include flexible hoses which connect to valves 16. A T-shaped pipe depicts a faucet adaptor 70. Faucet adaptor 70 connects valves 16 to faucet 66 in parallel with manually-operated valves contained in faucet 66. The encircled letters "H" and "C" represent any type of manually-operated valves in faucet 66. Redesign or modification of a conventional faucet is required for auto/manual faucet 66.

Embodiment E may also employ valve 44 or valve 46. In these two optional configurations, valve 44 or 46 replaces one or both valves 16 in FIG. 8A. The related circuitry for valve 44 or 46 is also necessary. Reference FIG. 4D electrical schematic or FIG. 5D block diagram, respectively.

OPERATION OF AUTO/MANUAL-FAUCET EMBODIMENT E—FIGS. 7, 7B

Operation of Embodiment E differs from operation of Embodiment A. In Embodiment A, water flow in valves 16 is dependent on any manually-operated valves in preexisting faucet 12. In Embodiment E, electric valves (16, 44, or 46) operate independent of manually-operated valves in faucet 66. The user can control water flow with conventional manually-operated valves, or by means of mat switches 14, in FIG. 7. This feature is particularly useful in the event of a power failure. Operation of Embodiment E is based on the user's selection of valve 16, 44, or 46. Refer to FIG. 7B for the operational explanation corresponding to valve 16, 44, or 46. Flow rate regulators in valves 16 are optional, at the user's discretion.

DESCRIPTION OF WATERSPOUT EMBODIMENT F—FIGS. 7, 1, 8B, 4D, 5D

Embodiment F differs from Embodiment A in that it uses waterspout 72, instead of preexisting faucet 12. Compare FIG. 7 and FIG. 1. Waterspout 72 contains no manually-operated valves. FIG. 8B shows waterspout 72 employing valves 16.

Embodiment F may also employ valve 44 or valve 46. In these two optional configurations, valve 44 or 46 replaces one or both valves 16 in FIG. 8B. The related circuitry for valve 44 or 46 is also necessary. Reference FIG. 4D electrical schematic or FIG. 5D block diagram, respectively.

OPERATION OF WATERSPOUT EMBODIMENT F—FIG. 7B

Operation of Embodiment F differs from operation of Embodiment A. Using Embodiment F in new basin fixtures eliminates the use, expense, and installation of manually-operated valves. Embodiment F is useful in applications where manually-operated valves are not necessary. Operation of Embodiment F is based on the selection of valve 16, 44, or 46. Reference FIG. 7B.

DESCRIPTION OF SINGLE-INPUT-WATERSPOUT EMBODIMENT G—FIG. 8C, 4C-4D, 5D, 6D-6E

Embodiment G differs from Embodiment F, in that it uses single-input waterspout 74, and only one valve (16, 44, or 46). FIG. 8C shows waterspout 74 using valve 16. See FIG. 4C for wiring.

Embodiment G may also employ two-stage-valve 44 or servo valve 46. In these two optional configurations, valve 44 or 46 replaces valve 16 in FIG. 8C. The related circuitry for valve 44 or 46 is also necessary. Reference FIG. 4D electrical schematic or FIG. 5D block diagram, respectively.

The water input for waterspout 74 may be a hot water line, a cold water line, a manual-mixing valve, or a solar-heater-water line. FIG. 8C does not show the input options.

Two more optional water inputs for Embodiment G involve combining waterspout 74 with Embodiment D. In these two optional configurations, faucet connector 24 in FIG. 8C connects to adaptor 20 in FIG. 6D or FIG. 6E. FIG. 6D and FIG. 6E also show the related plumbing and circuitry. Refer to the description of Embodiment D for further clarification of FIG. 6D and FIG. 6E.

OPERATION OF SINGLE-INPUT-WATERSPOUT EMBODIMENT G—FIG. 8C

Operation of Embodiment G differs from operation of Embodiment F as follows: In Embodiment F, it is possible to control the cold and hot water lines seperately. In Embodiment G, one valve (16, 44, or 46) controls all water flow, as in FIG. 8C. Embodiment G eliminates the expense and installation of an additional valve 16, 44, or 46. Embodiment G is useful in public facilities where usage is largely limited to hand washing.

DESCRIPTION OF INTERNAL-VALVE-WATERSPOUT EMBODIMENT H—FIG. 9-9A, 8C, 7, 4D, 5D

Embodiment H differs from Embodiment G in that valve 16, 44, or 46 mounts inside an internal-valve waterspout 76. Compare FIG. 8C and FIG. 9A. Redesign or modification of a conventional faucet is required for waterspout 76. Valve 16 and adaptors 18 and 20 are not seen in FIG. 9, because valve 16 is inside waterspout 76. Adaptors 18 and 20 are unnecessary. Compare FIG. 7 and FIG. 9. Water input options in Embodiment G also apply to Embodiment H.

Embodiment H may also employ two-stage valve 44 or servo valve 46. In these two optional configurations, valve 44 or 46 replaces valve 16 in FIG. 9A. The related circuitry for valve 44 or 46 is also necessary. Reference FIG. 4D electrical schematic or FIG. 5D block diagram, respectively.

OPERATION OF INTERNAL-VALVE-WATERSPOUT EMBODIMENT H—FIG. 9A

Operation of Embodiment H is identical to Embodiment G. Embodiment H facilitates installation because waterspout 76 and valve (16, 44, or 46) are one piece. Reference FIG. 9A. This feature is also useful in installations where there is no basin enclosure to cover under-sink plumbing.

SUMMARY, RAMIFICATIONS, AND SCOPE

Accordingly, the reader can see that the hands-free, leg-operated, faucet-control device described herein provides an economic and convenient water conservation method. It readily installs into new and preexisting basin fixtures, and allows for inexpensive decorative coordination. Users of any height can safely use the faucet-control device. An optional circuit minimizes electric power consumption when the faucet-control device is not in use. The solenoid-valve Embodiment A is the least expensive for preexisting basin fixtures. The single-input-waterspout Embodiment G, with a solenoid valve, is the least expensive for new basin fixtures. The mixing-valve Embodiment D with the optional servo-valve output is the most versatile. Because operation of the faucet-control device does not require use of the hands;

convenience and efficiency improve as users devote their hands to washing, rinsing, etc.;

users do not risk contamination of the hands from touching manually-operated controls; and water conservation improves because instead of using a constant flow of water while the hands are occupied, the user turns the water flow on and off with his/her lower body.

While the above description contains many specificities, these should not be construed as limitations on the scope of the hands-free, faucet-control device, but rather as exemplifications of some of the presently preferred embodiments thereof. Some variations are listed below:

Various combinations of the eight described embodiments are possible.

A thin veneer of basin fixture material placed over the mat switch makes it aesthetically neutral.

Pads, spacers, or water absorbent materials on the basin fixture with the mat switches may allow for improved comfort and better access to the switches in some installations.

Mat switches can enhance other devices, such as water-conservation devices (selective drainage), towel dispensers, soap dispensers, aids for the physically impaired, and hand driers.

A capacitive mat, demodulator, and adjustable-switching-threshold circuit can be combined. They could act as a mat switch and/or capacitive mat, with adjustable pressure sensitivity.

A mechanical override to open the electronic valve would allow use of the basin fixture without the faucet-control device if desired, or in the event of a power failure.

Valves made with custom inlets and outlets could eliminate the need for valve adaptors.

Accordingly, the scope of the hands-free, faucet-control device should be determined not by the embodiments illustrated, but by the appended claims and their legal equivalents.

I claim:

1. A faucet-control device comprising:

(a) at least one electrically-controlled, normally-closed valve, (b) adaptive means attached to said valve which facilitate installation into a basin fixture so as to control water flow therein, (c) at least one normally-open, momentary-contact mat switch, of sufficient flatness and thinness to facilitate vertical surface mounting on said basin fixture, of sufficient thinness that its protrusion is insignificant to the safety and comfort of a user when mounted on said basin fixture, and of sufficient sensitivity and surface area that user may readily close said mat switch by applying a predetermined pressure with a portion of his/her lower body, said mat switch conducts electric current when pressure applied thereto causes a pair of flexible conductors therein to flex, said flexible conductors are normally parallel to one another and not making electrical contact, and (d) at least one electronic circuit which provides electric current to open said valve, when said mat switch is closed, whereby user's lower body controls water flow in said basin fixture.

2. The faucet-control device of claim 1 further including electrical switches which:

(a) electrically bypass said mat switch, whereby user maintains water flow independent of said mat switch, when desired, and (b) electrically disconnect said valve from said electronic circuit, whereby user disables use of said valve when desired.

3. The faucet-control device of claim 1 further including a variable timer which electrically bypasses said mat switch for approximately 5 to 90 seconds, whereby user maintains water flow for a selected time independent of said mat switch.

4. The faucet-control device of claim 1 further including a faucet containing at least one manually-operated valve which connects in parallel with said electrically-controlled valve, whereby user controls water flow with said mat switch or said manually-operated valve.

5. The faucet-control device of claim 1 further including a faucet containing at least one manually-operated valve in series with said electrically-controlled valve, whereby user controls water flow with said mat switch and said manually-operated valve.

6. The faucet-control device of claim 1 further including a waterspout in series with said valve, whereby the use, installation, and expense of manually-operated valves are unnecessary.

7. The faucet-control device of claim 1 wherein:

(a) a plurality of said mat switches with predetermined different pressure sensitivities is stacked with the more sensitive atop the less sensitive, and (b) said electronic circuits are configured such that said stacked mat switches separately control a plurality of said valves, whereby user separately controls a plurality of said valves with one point of contact.

8. The faucet-control device of claim 1 wherein:

(a) said valve is a multiple-stage valve, with a plurality of flow rates, (b) a plurality of said mat switches with predetermined different pressure sensitivities is stacked with the more sensitive atop the less sensitive, and (c) said electronic circuit is configured such that said stacked mat switches activate said multiple-stage valve stages, whereby user selects multiple flow rates with his/her lower body.

9. The faucet-control device of claim 8 further including a waterspout in series with said multiple-stage valve, whereby the use, expense, and installation of manually-operated valves are unnecessary.

10. The faucet-control device of claim 1 further including a capacitive mat 50 which is shaped and mounted as said mat switch, which acts as a variable capacitor as pressure is applied thereto, because of the decreasing distance between two flexible conductors therein, wherein:

(a) said valve is a servo valve, capable of variable flow rates, with electronic servo control, said servo valve is normally closed and begins with minimal flow, (b) said mat switch mounts atop said capacitive mat, and has a predetermined sensitivity to flexing under pressure greater than said capacitive mat, and (c) said electronic circuit contains an oscillator, demodulator, and servo circuit which;

(i) activate minimal flow in said servo valve when said mat switch is closed, (ii) convert variable capacitance from said capacitive mat to a servo output which drives said servo valve in response to pressure applied to said capacitive mat, and (iii) provide a variable current source which enables user to manually set a selected flow rate independent of said capacitive mat, whereby user selects variable flow rates by applying variable pressure to said mat switch with his/her lower body, or by manually selecting desired flow rate with said variable current source.

11. The faucet-control device of claim 10 further including a waterspout in series with said servo valve, whereby the use, expense, and installation of manually-operated valves are unnecessary.

12. The faucet-control device of claim 1 further including a capacitive mat 50 which is shaped and mounted as said mat switch, which acts as a variable capacitor as pressure is applied thereto, because of the decreasing distance between two flexible conductors therein, wherein:

(a) said valve is a mixing valve which mixes hot and cold water inputs in variable proportions into a single output based upon an electronic servo input, said mixing valve is normally closed, initially opens with all cold water flow, and gradually mixes in larger proportions of hot water as said electronic servo input increases, (b) said mat switch mounts atop said capacitive mat and has a predetermined sensitivity to flexing under pressure greater than said capacitive mat, and (c) said electronic circuit contains an oscillator, demodulator, and servo circuit which;

(i) activate cold water flow in said mixing valve when said mat switch is closed, (ii) convert variable capacitance from said capacitive mat to a servo output which drives said mixing valve in response to pressure applied to said capacitive mat, and (iii) provide a variable current source which enables user to manually set a selected temperature independent of said capacitive mat, whereby, user selects variable water temperatures by applying variable pressure to said mat switch, or by selecting desired temperature with said variable current source.

13. The faucet-control device of claim 12 further including a waterspout in series with said mixing valve, whereby the expense and installation of manual valves are unnecessary.

14. The faucet-control device of claim 1 further including an encasement which is aesthetically and functionally designed for use in rooms with basin fixtures, said encasement includes:

(a) an electric-power-input plug which accesses power for said electronic circuit, (b) a power outlet corresponding to said electric-power-input plug, whereby availability of power outlets is not lessened by said electric-power-input plug, and (c) mounting space for said electronic circuit.

15. The faucet-control device of claim 1 further including a power-saving device comprising:

(a) a step-down transformer whose load is said electronic circuit and said valve, said load is in series with said mat switch and said transformer secondary output, (b) a current-limiting resistor in series with said transformer primary input, which significantly reduces current in said transformer primary, (c) a double-pole, double-throw relay whose coil activates at voltages less than one half of said transformer secondary output, said relay coil is in series with said mat switch and said transformer secondary output, said relay coil activates with currents sustainable with said current-limiting resistor in series with said transformer primary input, (d) a protection resistor in series with said relay coil, which drops said transformer secondary output voltage to a voltage which activates said relay coil at stress free levels, and (e) electrical conductors between said relay, said current-limiting resistor, and said protection resistor such that, (i) first single-pole, double-throw section of said relay electrically bypasses said current-limiting resistor, when activated, and (ii) second single-pole, double-throw section of said relay electrically bypasses said protection resistor, when not activated;

whereby said transformer primary conducts reduced current through said current-limiting resistor when said mat switch is open and said load is idle.

16. The faucet-control device of claim 15 wherein:

(a) said relay is triple-pole, double-throw, (b) said load receives current from said transformer through third single-pole, double-throw section of said relay, when said relay is activated, and (c) said mat switch conducts current only to said relay coil, whereby said mat switch conducts reduced currents.

* * * * *